US008235689B2

(12) United States Patent
Ciavarella et al.

(10) Patent No.: US 8,235,689 B2
(45) Date of Patent: Aug. 7, 2012

(54) PISTON PUMP WITH ROTATING PUMP ACTUATOR

(75) Inventors: Nick E. Ciavarella, Seven Hills, OH (US); David D. Hayes, Wooster, OH (US)

(73) Assignee: GOJO Industries, Inc., Akron, OH (US)

( * ) Notice: Subject to any disclaimer, the term of this patent is extended or adjusted under 35 U.S.C. 154(b) by 937 days.

(21) Appl. No.: 12/290,725

(22) Filed: Nov. 3, 2008

(65) Prior Publication Data

US 2010/0111732 A1 May 6, 2010

(51) Int. Cl.
*F04B 7/06* (2006.01)

(52) U.S. Cl. ..... 417/500; 417/437; 417/492; 417/490; 222/613; 222/617; 222/628; 222/469; 222/470

(58) Field of Classification Search ..... 417/437, 417/492, 500, 490; 222/613, 617, 628, 469, 222/470, 111, 341

See application file for complete search history.

(56) References Cited

U.S. PATENT DOCUMENTS

| | | | | |
|---|---|---|---|---|
| 2,540,357 A | | 3/1946 | Stanley | |
| 2,657,834 A | * | 11/1953 | Bacheller | 222/321.9 |
| 3,592,357 A | * | 7/1971 | Welch | 222/630 |
| 3,807,909 A | * | 4/1974 | St. Clair | 417/517 |
| 4,277,001 A | * | 7/1981 | Nozawa | 222/321.4 |
| 4,418,656 A | * | 12/1983 | Stanton | 123/56.9 |
| 4,479,759 A | * | 10/1984 | Zeitz | 417/500 |
| 4,493,440 A | * | 1/1985 | von Buelow et al. | 222/109 |
| 4,824,336 A | | 4/1989 | Iwaki et al. | |
| 4,854,837 A | * | 8/1989 | Cordray | 417/492 |
| 4,960,369 A | * | 10/1990 | Graves | 417/536 |
| 5,114,314 A | | 5/1992 | Fujimoto | |
| 5,271,530 A | * | 12/1993 | Uehira et al. | 222/190 |

(Continued)

FOREIGN PATENT DOCUMENTS

GB 283401 1/1928

OTHER PUBLICATIONS

International Preliminary Report on Patentability from International Application No. PCT/US2009/062667, dated May 3, 2011.

*Primary Examiner* — Peter Macchiarolo
*Assistant Examiner* — Thomas A Hollweg
(74) *Attorney, Agent, or Firm* — Calfee, Halter & Griswold LLP

(57) ABSTRACT

A reciprocating piston liquid pump and piston driver mechanism includes a reciprocating piston liquid pump having a piston chamber and a piston reciprocating in the piston chamber from an unactuated position to an actuated position, with movement of the piston from the unactuated position to the actuated position causing the advancement of product. The piston driver mechanism includes a first driver member having an axis and a sloped circumferential surface extending along its axis, and a second driver member having an axis and a sloped circumferential surface extending along its axis. The first and second driver members are aligned along their axes and mate at an unactuated position along at least a portion of their sloped circumferential surfaces. Rotation of one of the driver members about its axis relative to the other of the driver members causes the second driver member to advance away from the first driver member toward an actuated position. This movement also causes movement of the piston to its actuated position, thus advancing product.

10 Claims, 5 Drawing Sheets

U.S. PATENT DOCUMENTS 5,277,559 A * 1/1994 Schultz ..... 417/543
5,312,233 A * 5/1994 Tanny et al. ..... 417/316
5,472,322 A 12/1995 Huet et al.
5,676,277 A * 10/1997 Ophardt ..... 222/83
5,741,126 A * 4/1998 Stearns et al. ..... 417/490
5,897,031 A * 4/1999 Wirt et al. ..... 222/179
5,961,303 A * 10/1999 King ..... 417/492
5,975,360 A * 11/1999 Ophardt ..... 222/83
6,082,586 A * 7/2000 Banks ..... 222/95
6,409,050 B1 * 6/2002 Ophardt et al. ..... 222/181.1
6,540,117 B2 * 4/2003 Powling ..... 222/341
6,557,736 B1 * 5/2003 Ophardt ..... 222/321.9
6,568,561 B2 5/2003 Studer et al.
6,729,502 B2 * 5/2004 Lewis et al. ..... 222/181.3
7,299,740 B2 * 11/2007 Adams ..... 92/71
7,641,077 B2 * 1/2010 Law et al. ..... 222/190
7,984,829 B2 * 7/2011 Cittadino et al. ..... 222/153.03
2005/0276707 A1 * 12/2005 Ophardt ..... 417/437
2008/0314238 A1 * 12/2008 Neuner ..... 92/143

* cited by examiner

PISTON PUMP WITH ROTATING PUMP ACTUATOR

FIELD OF THE INVENTION

The present invention generally relates to reciprocating piston liquid pumps. More particularly, this invention relates to a reciprocating piston liquid pump that is actuated by a rotating actuator mechanism. The rotating actuator mechanism converts a linearly actuation motion in a horizontal plane to linear motion in an off-vertical plane to advance the piston of the piston pump and cause the piston pump to advance product.

BACKGROUND OF THE INVENTION

Reciprocating piston liquid pumps are well known in the art, and are employed to pump and/or dispense various products. Many well known reciprocating piston liquid pumps are found in desktop dispensers wherein a dispensing spout is pressed down to dispense product onto a hand held under the dispensing spout. Soaps, lotions and sanitizers are among the most common products dispensed with such pumps.

These pumps are also employed in environments other than desktop dispensers. For instance, it is common to find a reciprocating piston liquid pump in a wall-mounted dispenser wherein a push bar is pressed to actuate the pump and dispense product onto a hand held under the push bar. In these dispensers, the push bar typically pivots at a pivot point and provides arms that operatively engage the reciprocating piston of the pump such that pressing on and releasing the push bar causes the reciprocating movement of the piston necessary for dispensing the product from a product container to which the pump is secured. Because the stroke length of the reciprocating piston is dictated by the distance the push bar arms move, the desired stroke length can be achieved either by designing the push bar to pivot through a necessary arc, or by sizing the arms to engage the pump at a significant distance fro the push bar, thus permitting a smaller arc. The arms extending from the push bar engage a linearly moving actuating carriage engaging the reciprocating piston, so, with longer arms, more linear motion is achieved with a smaller push bar arc. However, because lever arms are employed between the push bar and the actuation carriage, the mechanical advantage offered by the push bar must be significant enough that the user of the dispenser does not have to push too hard to dispense product. Thus, the push bar of the prior art is typically long in length and travels through a significant rotational arc. As a result, the dispenser can take up a larger footprint.

The present invention seeks to address the need in the art for actuating mechanisms for reciprocating piston liquid pumps for wall-mounted dispensers wherein the push bar dimensions are smaller and the arc length is decreased such that the wall-mounted dispenser can occupy a smaller footprint.

SUMMARY OF THE INVENTION

In general, this invention provides a reciprocating piston liquid pump and a piston driver mechanism. The reciprocating piston liquid pump includes a piston chamber and a piston reciprocating in the piston chamber from an unactuated position to an actuated position, with movement of the piston from the unactuated position to the actuated position causing the reciprocating piston liquid pump to advance product. The piston driver mechanism includes a first driver member having an axis and a sloped circumferential surface extending along its axis, and a second driver member having an axis and a sloped circumferential surface extending along its axis. The first and second driver members are aligned along their axes and mate at an unactuated position along at least a portion of their sloped circumferential surfaces such that rotation of one of the driver members about its axis relative to the other of the driver members causes the second driver member to advance away from the first driver member toward and actuated position along its axis through the interaction of the sloped circumferential surfaces. This movement also causes movement of the piston to its actuated position, thus advancing product.

DETAILED DESCRIPTION OF ILLUSTRATIVE EMBODIMENTS

Figure 1:
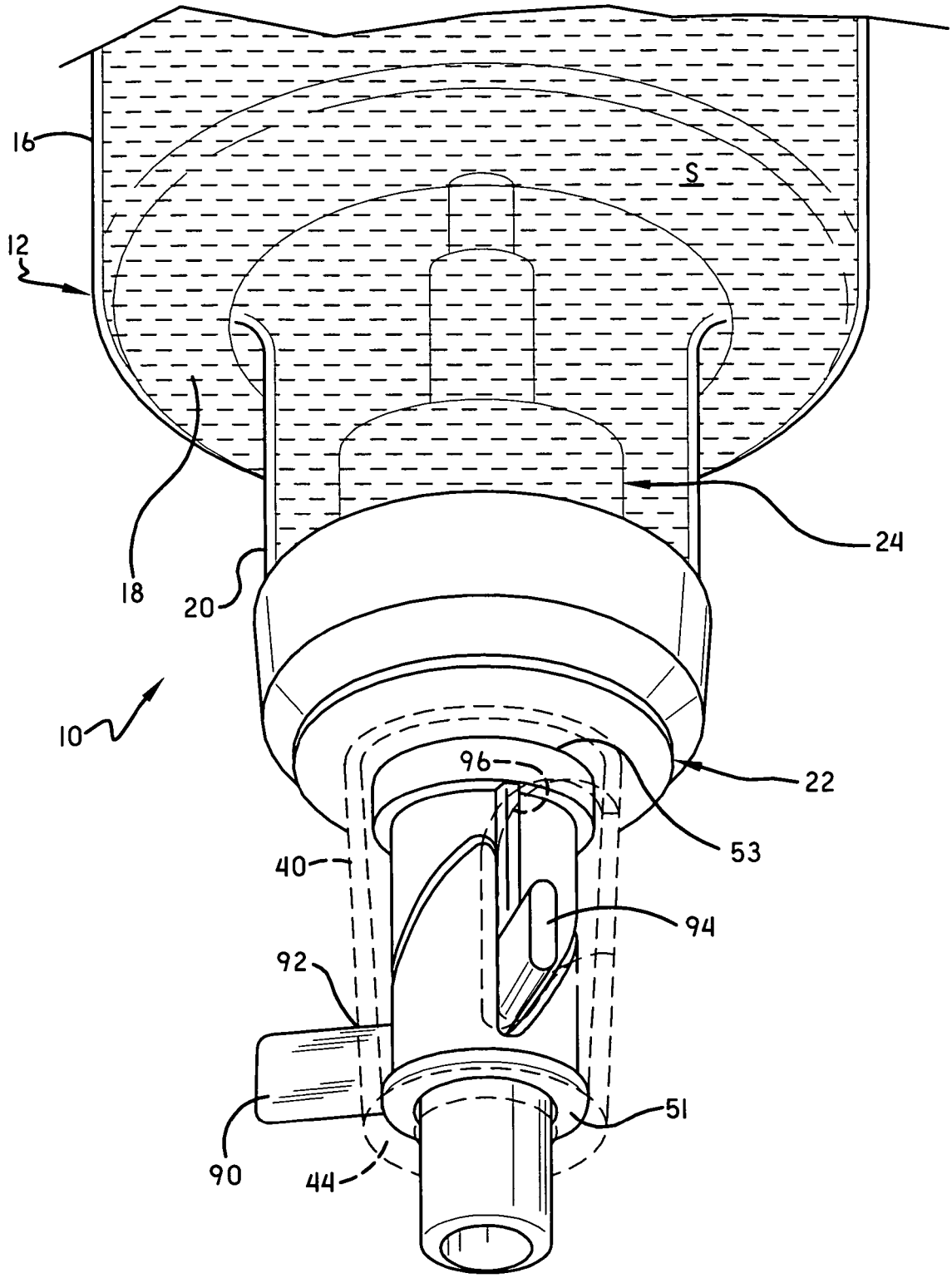
FIG. 1 is a perspective of a reciprocating piston liquid pump and piston driver mechanism in accordance with first embodiment of this invention, shown with certain elements thereof in phantom in order to view driver members of the pump.
Figure 2:
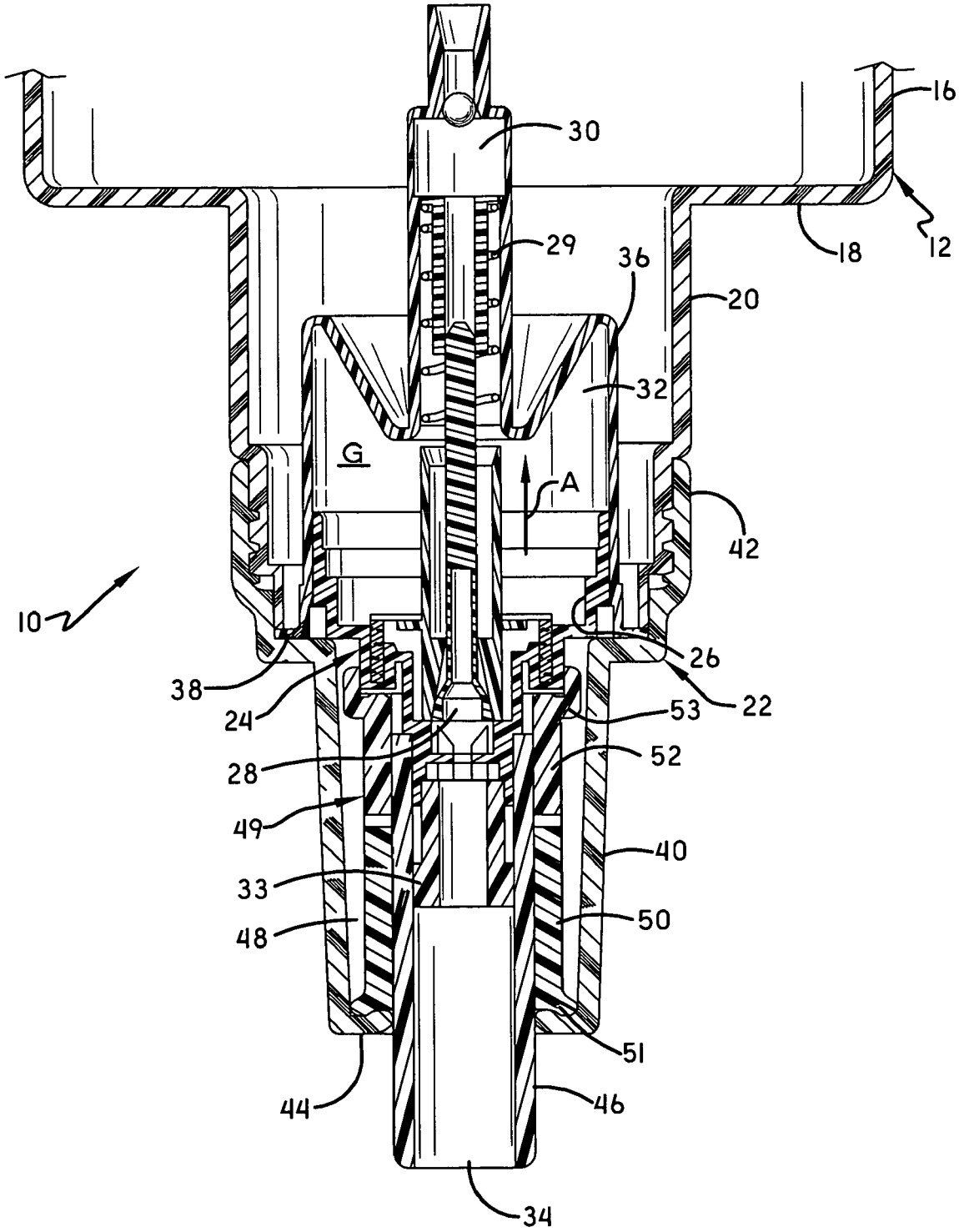
FIG. 2 is a cross sectional view of the first embodiment.

In FIGS. 1 and 2, a reciprocating piston liquid pump and piston driver mechanism in accordance with this invention is shown and designated by the numeral 10. This pump and driver mechanism 10 are secured to a container 12 holding a product S for advancement and/or dispensing. The container 12 includes a bottom 4-4, a side wall 16, a shoulder 18, and a neck 20. The container 12 may be a rigid plastic container, in which case it would typically have to be vented so that air can replace the product S as it is dispensed, but the container might also be a collapsible container such that no venting is necessary. Indeed, in some embodiments, the container 12 shown here might be replaced with a bag-type product container with an appropriate fitment to the reciprocating piston pump and piston driver mechanism 10. The types of containers and their joining to a piston pump are well known in the art. The present invention is particularly directed to the piston driver mechanism.

In this embodiment, an over cap 22 engages the neck 20 at mating threads, and a reciprocating piston liquid pump 24 extends through the over cap 22 to close off the open top provided by the neck 20. The reciprocating piston liquid pump 24 includes a reciprocating piston member 26 having an outlet passage 28, and the reciprocating piston member 26 is moved against the bias of a spring 29 to dispense the liquid S retained in the container 12. More particularly, the reciprocating piston member 26 interacts with both a liquid chamber 30 and an air chamber 32 such that, as the reciprocating piston member 26 is moved against the bias of the spring 29, both liquid S and air G are advanced into and through the outlet passage 28 in order to create a foam product. Reciprocating piston pumps of this type are well known, and the particular structure to be employed for a reciprocating piston liquid pump 24 is not material to this invention. Indeed, the main structures of a prior art reciprocating piston liquid pump and container could be employed, to be modified to include the piston driver mechanism in accordance with this invention. The reciprocating piston liquid pump 24 is provided with appropriate valves and, preferably, a screen bounded mixing cartridge, as known, such that liquid S is dispensed as foam at outlet 34 of the outlet passage 28 when the reciprocating piston 26 is forced upwardly in the direction of arrow A. Although the present invention shows a foam pump, it should be appreciated that a common, non-foam reciprocating piston liquid pump could also be modified with the piston driver mechanism in accordance with this invention.

The body member 36 of the reciprocating piston liquid pump 24 provides the liquid chamber 30 and the air chamber 32 with which the reciprocating piston 26 interacts to advance and dispense foam. This body member 36 is secured to the top of the neck 20 of the container 12 by a flange 38, which is wedged against the open top of the neck 20 by the over cap 22. The over cap 22 includes a drive member cap 40 extending axial from the container cap portion 42 to extend alongside and at least partially surround the reciprocating piston 26. A resistance flange 44 extends radially inwardly from the drive member cap 40 to lie in close proximity to the dispensing spout 46 extending from the piston portion 26. An annular gap 48 is formed between the over cap 22 and the reciprocating piston 26 and dispensing spout 46 and the driver mechanism 49 of the pump and driver mechanism 10 is positioned therein.

Figure 6:
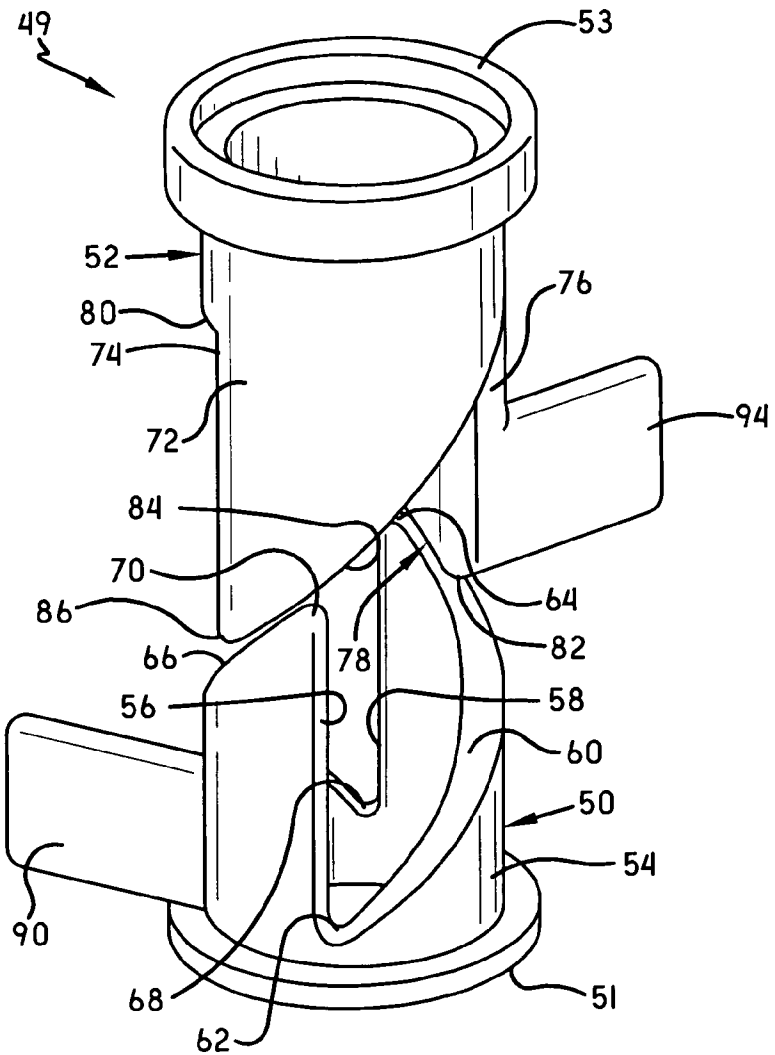
FIG. 6 is a perspective view of the driver members of the reciprocating piston pump, provided to show their interaction in an actuated position.
Figure 5:
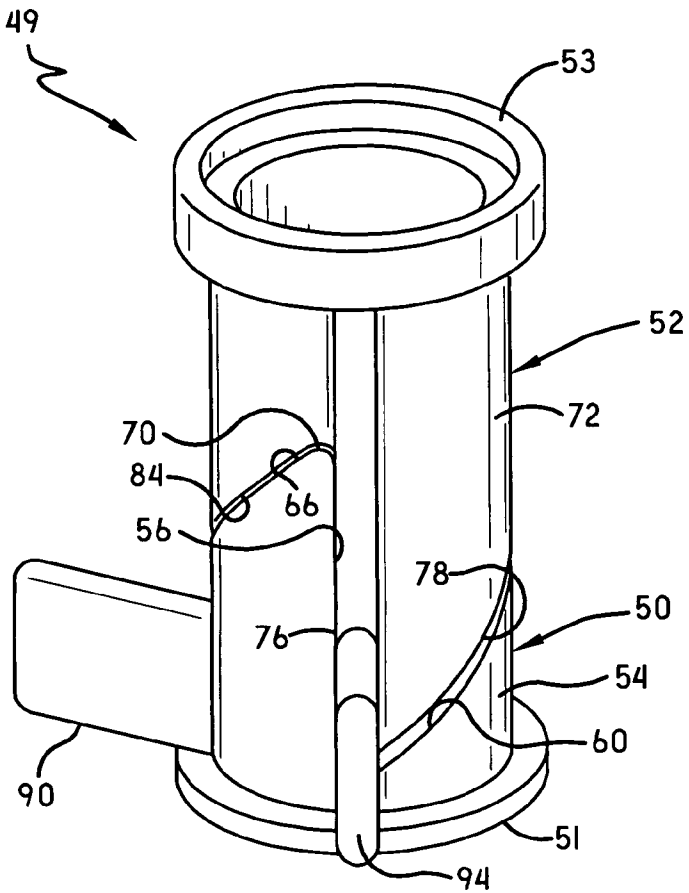
FIG. 5 is a perspective view of the driver members of the reciprocating piston pump, provided to show their interaction in an unactuated position.

Referring to FIGS. 5 and 6, the driver mechanism 49 includes a first drive member 50 and a second drive member 52. The first drive member 50 is generally tubular and permits the passage of pump and/or dispensing tube elements there through. The first drive member has a sidewall 54 that is cut out to provide a first axial extension 56 opposite a second axial extension 58. A first sloped circumferential surface 60 extends from the base 62 of the first axial extension 56 to the tip 64 of the second axial extension 58, and a second sloped circumferential surface 66 extends from the base 68 of the second axial extension 58 to the tip 70 of the first axial extension 56. Similarly, the second drive member 52 is generally tubular to also permit the passage of pump and/or dispensing tube element there through. The second drive member has a sidewall 72 that is cut out to provide a first axial extension 74 opposite a second axial extension 76. A first sloped circumferential surface 78 extends from the base 80 of the first axial extension 74 to the tip 82 of the second axial extension 76, and a second sloped circumferential surface 84 extends from the base (not shown) of the second axial extension 76 to the tip 86 of the first axial extension 74.

The first driver member 50 and the second driver member 52 are axially aligned to mate in the unactuated position along at least a portion of their respective sloped circumferential surfaces, with the first sloped circumferential surface 60 of the first drive member 50 mating with the first sloped circumferential surface 78 of the second drive member 52, and the second sloped circumferential surface 66 of the first drive member 50 mating with the second sloped circumferential surface 84 of the second drive member 52. In the embodiment shown, the first and second drive members 50, 52 mate circumferentially along their respective first axial extensions 56, 76 and second axial extensions 58, 74 and each sloped circumferential surface 60, 66, 78, 84 has a similar slope such that they together form a completed tubular construct. However, the first and second drive members 50, 52 need not nest together in such an intimate fashion, it being sufficient that they at least mate along a portion of their respective sloped circumferential surfaces. This will be appreciated as the functioning of the driver mechanism 49 is disclosed.

In the unactuated position shown in FIGS. 1 and 2, a contact surface 51 of the first drive member 50 engages the resistance flange 44 of the over cap 22, and a contact surface 53 of the second drive member 52 engages or at least operatively engages the reciprocating piston 26. A first drive arm 90 extends radially from the first drive member 50 through a first arm aperture 92 in the drive member cap 40 and, similarly, a second drive arm 94 extends radially outwardly from the second drive member 52 through a second arm aperture 96 in the drive member cap 40. These arms may be pushed linearly in order to actuate the reciprocating piston liquid pump 24. This can be particularly appreciated from a review of FIGS. 5 and 6.

As the first drive arm 90 and second drive arm 94 are pushed, they rotate about their axes, and this causes the second driver member 52 to advance away from the first driver member 50, which is held in place due to the interaction of the contact surface 51 with the resistance flange 44 of the over cap 22. The advancement of the second driver member 52 causes the reciprocating piston 26 to be moved against the bias of a spring 29 to advance and/or dispense the liquid S retained in the container 12. The first and second arm apertures 92 and 96 are sized appropriately to permit radial movement of the first drive arm 90 and to permit radial and axial movement of the second drive arm 94. Once pressure is released from the first and second drive arms 90, 94, the spring 29 will return the pump and driver mechanism 10 to the unactuated position, ready for another actuation. In a wall-mounted dispenser embodiment, the pump and driver mechanism 10 would be included as part of a refill unit including the container of liquid S and this refill unit would be held by a wall-mounted dispenser housing. The refill unit would mount inside of the housing such that the common push bar would engage the first and second drive arms 90, 94 to push them linearly when the push bar is pivoted to dispense product as is common in wall-mounted dispensers. As an alternative, the first and second drive arms 90, 94 can be pushed by electronic elements actuated by a touchless sensor as is commonly employed in certain wall-mounted dispensers.

It will be appreciated that first and second driver arms 90, 94 are not required, inasmuch as it would be possible to provide only one drive arm. With only one drive arm being linearly actuated, the sloped circumferential surfaces of the first and second drive members would still advance away from each other as seen in FIGS. 5 and 6. However, with only one arm extending from one of the first and second drive members, the stroke length of the linear actuation in the linear direction would have to be longer to achieve the same pump stroke length that is achieved by a shorter linear actuation stroke length when two arms are employed. Thus, to ensure that a push bar can be designed smaller and with a shorter stroke length, it is preferred that two arms are employed to be engaged by a push bar. This will help ensure that the footprint of the dispenser can be kept as small as possible. It should also be appreciated that, while each drive member includes two axial extensions and two sloped circumferential surfaces, it would be possible to provide each drive member with one axial extension and one slope circumferential surface. Thus, the multiple arms and multiple sloped circumferential sloped surfaces are merely preferred embodiments, and this invention is not limited thereto or thereby.

Figure 3:
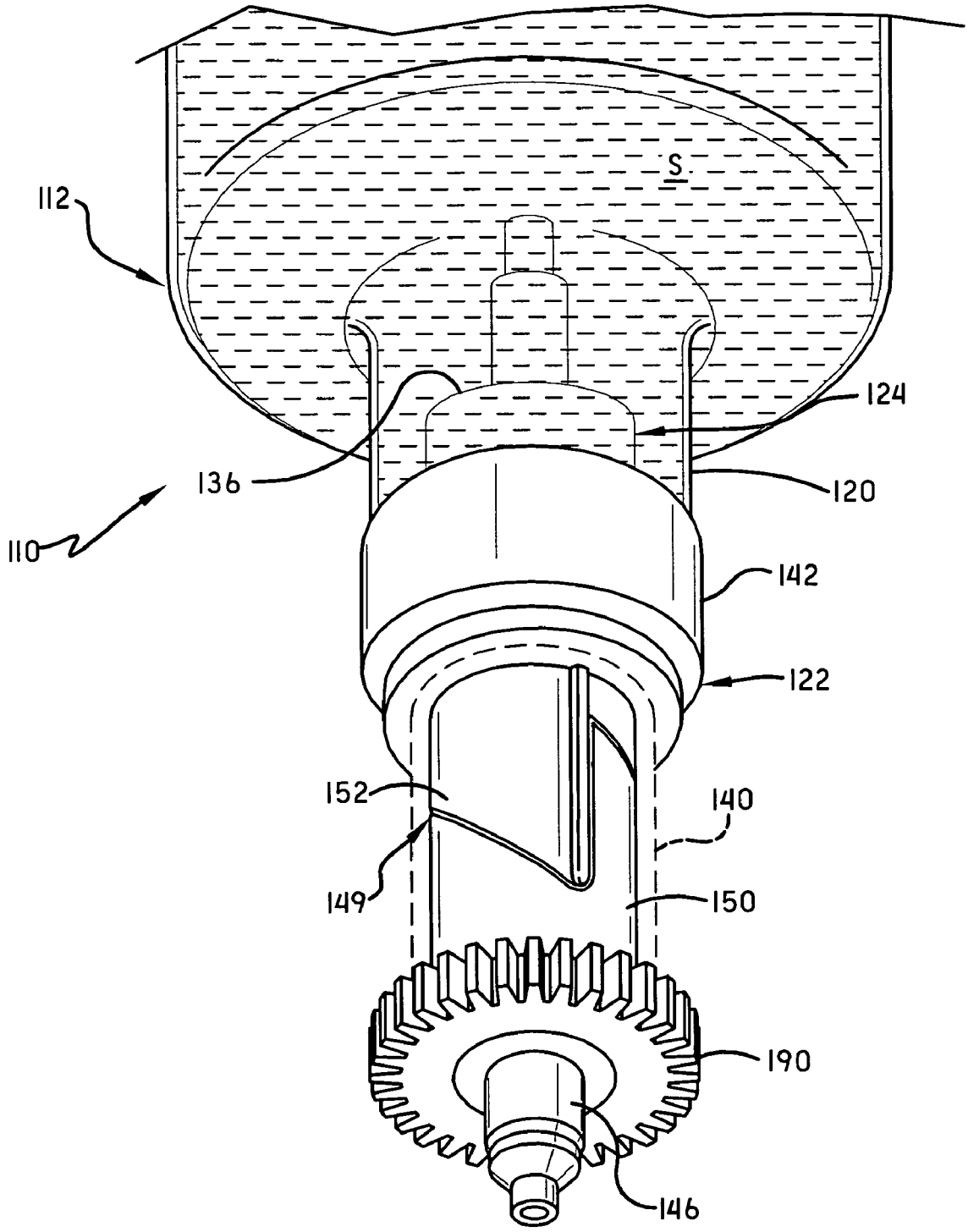
FIG. 3 is a perspective of a reciprocating piston liquid pump and piston driver mechanism in accordance with a second embodiment of this invention, shown with certain elements thereof in phantom in order to view driver members of the pump.
Figure 4:
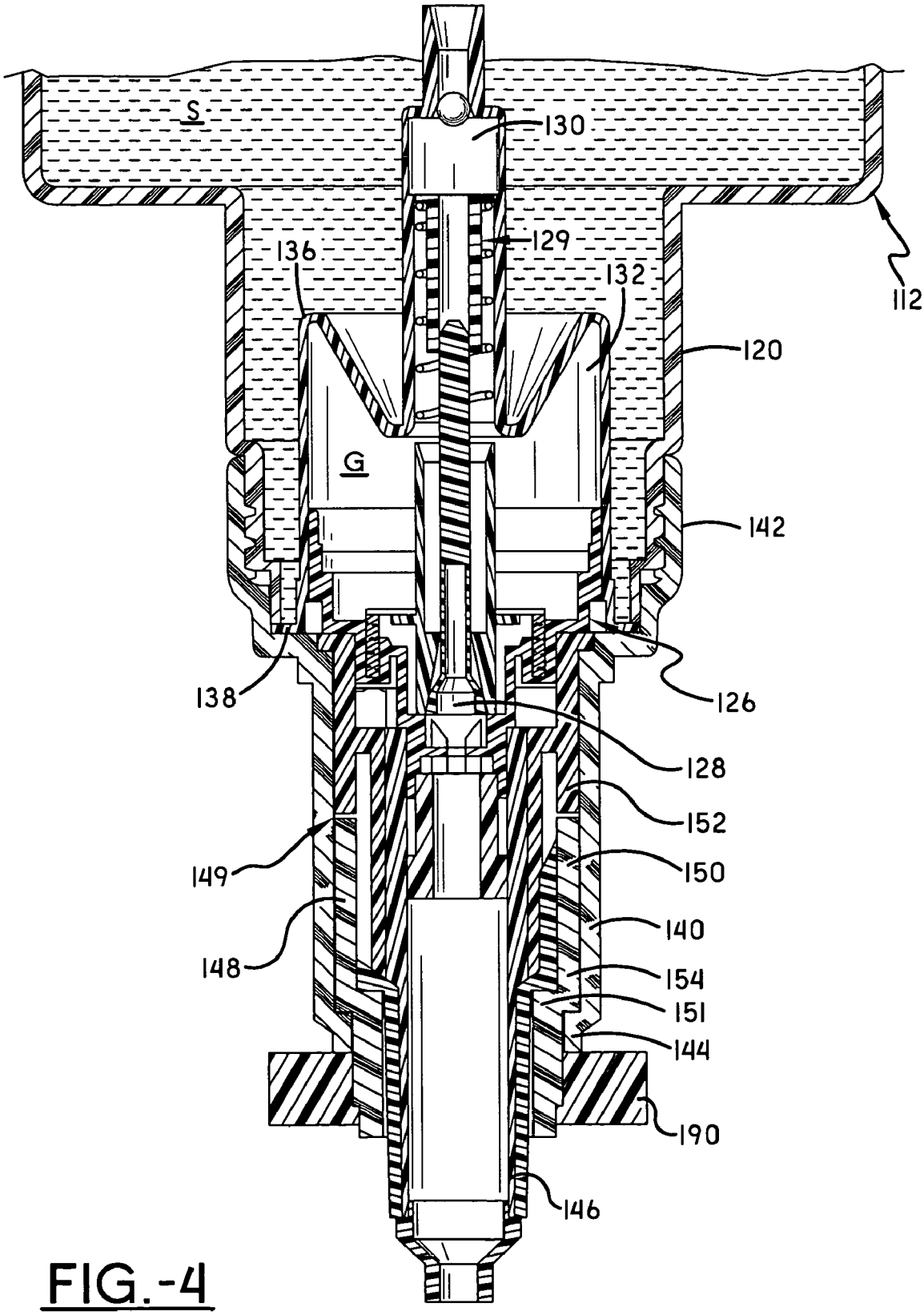
FIG. 4 is a cross sectional view of the second embodiment.

Referring now to FIGS. 3 and 4, it can be seen that pushing drive arms is not the only means for causing the second drive member to advance away from the first drive member to actuate the pump. In FIGS. 3 and 4, a second embodiment of a reciprocating piston liquid pump and piston driver mechanism is shown and designated by the numeral 110. This pump and driver mechanism 110 is secured to a container 112 holding a product S for advancement and/or dispensing. This container 112 can be substantially identical to that described for container 12 of the pump and driver mechanism 10. Indeed, many elements of the pump and driver mechanism 110 are identical to the elements of the pump and driver mechanism 10 and therefore are identified with similar numerals, though increased by 100.

Thus, an over cap 122 engages a neck 120 at mating threads, and a reciprocating piston liquid pump 124 extends through the cap 122 to close off the open top provided by the neck 120. The reciprocating piston liquid pump 124 includes a reciprocating piston member 126 having an outlet passage 128, and the reciprocating piston member 126 is moved against the bias of a spring 129 to dispense the liquid S retained in the container 112. More particularly, the reciprocating piston member 126 interacts with both a liquid chamber 130 and an air chamber 132 such that, as the reciprocating piston member 126 is moved against the bias of the spring 129, both liquid S and air are advanced into and through the outlet passage 128 in order to create a foam product. Although the present invention shows a foam pump, it should be appreciated that a common, non-foam reciprocating piston liquid pump could also be modified with the piston driver mechanism in accordance with this invention.

The body member 136 of the reciprocating piston liquid pump 124 provides the liquid chamber 130 and the air chamber 132 with which the reciprocating piston 126 interacts to advance and dispense foam. This body member 136 is secured to the top of the neck 120 of the container 112 by a flange 138, which is wedged against the open top of the neck 120 by the over cap 122. The over cap 122 includes a drive member cap 140 extending axial from the container cap portion 142 to extend alongside and at least partially surround the reciprocating piston 126. A resistance flange 144 extends radially inwardly from the drive member cap 140 to lie in close proximity to the dispensing spout 146 extending from the piston portion 126. An annular gap 148 is formed between the over cap 122 and the reciprocating piston 126 and dispensing spout 146 and the driver mechanism 149 of the pump and driver mechanism 110 is positioned therein.

The driver mechanism 149 is substantially identical to the driver mechanism 49 disclosed above with respects to FIGS. 5 and 6. However, this driver mechanism 149 is driven by the movement of a gear 190, as opposed to first and second drive arms 90, 94. Thus, the driver mechanism 149 includes first and second drive members 150, 152 which interact substantially as already described with respect to first and second drive members 50, 52, and the various sloped surfaces and axial extensions of the first and second drive members 150, 152 need not be repeated in detail here. Rather, some minor structural distinctions between the first driver member 50 of the first embodiment and the first driver member 150 of the second embodiment are next disclosed, with the actuation of the pump and driver mechanism 110 following thereafter.

As seen in FIG. 4, the contact surface 151 of the first drive member 150 is not provided at a terminal end of the first drive member 150, as it was in the first driver member 50. Instead, it is provided as a step in the side wall 154. From this step providing the contact surface 151, the side wall 154 continues to extend axially outside of the over cap 122 to provide a length of the side wall 154 to which a gear 190 is secured. It should be appreciated that rotation of the gear 190 will cause the interaction of the sloped circumferential surfaces necessary for actuating the reciprocating piston liquid pump 124. This gear 190 can be engaged by a rack on a push bar or could be engaged by electronic elements for actuation by tripping a touchless sensor. The contact surface 151 of the first drive member 150 engages the resistance flange 144 of the over cap 122 such that the first drive member 150 remains in its axial position, while the second drive member 152 is advanced to cause the reciprocation of the reciprocating piston 126.

In light of the foregoing, it should be appreciated that the present invention advances the art by providing a reciprocating piston liquid pump and piston driver mechanism particularly useful for providing wall-mounted dispensers having push bars that take up a smaller footprint. However, this invention is not limited to wall-mounted dispensers employing push bars. The scope of this invention will be defined by the following claims.

What is claimed is:

1. A pump and pump driver mechanism comprising:
- a piston chamber;
- a piston reciprocating in said piston chamber; a piston driver mechanism for moving the piston in a reciprocating motion including:
  - a first driver member having an axis and a sloped circumferential surface extending along said axis,
  - a second driver member having an axis and a sloped circumferential surface extending along said axis, said first and second driver members being aligned along their axes along at least a portion of their sloped circumferential surfaces, wherein rotation of one of said driver members about its axis relative to the other of said driver members causes said second driver member to advance away from said first driver member along said axis through the interaction of said circumferential sloped surfaces, said movement also causing movement of said.

2. The pump and pump driver of claim 1, wherein rotation of one of said driver members relative to the other of said driver members is effected by a driving force, and said piston is biased toward a first position position by a biasing member to return said piston to said first position upon release of said driving force.

3. The pump and pump driver of claim 1, wherein said first driver member is tubular, having a sidewall providing said sloped circumferential surface thereof and said second driver member is tubular, having a sidewall providing said sloped circumferential surface thereof.

4. The pump and pump driver of claim 3, wherein said sloped circumferential surface of said first driver member includes an axial extension having a base and a tip, and said sloped circumferential surface thereof extends circumferentially from said base to said tip.

5. The pump and pump driver of claim 4, wherein said sloped circumferential surface of said second driver member includes an axial extension having a base and a tip, and said sloped circumferential surface thereof extends circumferentially from said base to said tip.

6. The pump and pump driver of claim 5, wherein said first and second driver members mate radially at their respective axial extensions, and their respective sloped circumferential surfaces mate together to from a tubular construct.

7. The pump and pump driver of claim 3, further comprising an axial passage through said first and second driver members defined by said sidewalls of said first and second driver members.

8. The pump and pump driver of claim 7, wherein a dispensing tube extends through said axial passage of said first and second driver members.

9. The pump and pump driver of claim 1, wherein said first driver member includes an arm, said arm being driven to rotate said first driver member about its axis relative to said second driver member.

10. The pump and pump driver of claim 9, wherein said second driver member includes an arm, said arm being driven to rotate said second driver member about its axis relative to said first driver member.

* * * * *